US011264729B2

(12) United States Patent
Hand et al.

(10) Patent No.: US 11,264,729 B2
(45) Date of Patent: Mar. 1, 2022

(54) WIDE SCAN PHASED ARRAY FED REFLECTOR SYSTEMS

(71) Applicant: LOCKHEED MARTIN CORPORATION, Bethesda, MD (US)

(72) Inventors: Thomas Henry Hand, Highlands Ranch, CO (US); Arun Kumar Bhattacharyya, Littleton, CO (US); Joseph M. Torres, Littleton, CO (US); Scott Alan Lundgren, Littleton, CO (US); Konrad J. Gojara, Littleton, CO (US); Grayeme Everett Platt, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 276 days.

(21) Appl. No.: 16/226,445

(22) Filed: Dec. 19, 2018

(65) Prior Publication Data

US 2019/0190146 A1 Jun. 20, 2019

Related U.S. Application Data

(60) Provisional application No. 62/607,864, filed on Dec. 19, 2017.

(51) Int. Cl.
*H01Q 19/17* (2006.01)
*H01Q 3/26* (2006.01)
(Continued)

(52) U.S. Cl.
CPC ..... *H01Q 19/17* (2013.01); *H01Q 3/2658* (2013.01); *H01Q 3/2676* (2013.01);
(Continued)

(58) Field of Classification Search
CPC ..... H01Q 25/007; H01Q 19/17; H01Q 19/175
See application file for complete search history.

(56) References Cited

U.S. PATENT DOCUMENTS 3,713,163 A * 1/1973 Keller ..... H01Q 3/245 343/754
3,983,560 A 9/1976 MacDougall
(Continued)

FOREIGN PATENT DOCUMENTS

WO WO-2017056136 A1 * 4/2017 ..... H01Q 19/06

OTHER PUBLICATIONS

Moreira, F.J.S., et al., "Generalized Classical Axially Symmetric Dual-Reflector Antennas," IEEE Transactions on Antennas and Propagation, vol. 49, No. 4, pp. 547-554, Apr. 2001.
(Continued)

*Primary Examiner* — Gregory C. Issing
(74) *Attorney, Agent, or Firm* — Morgan, Lewis & Bockius LLP

(57) ABSTRACT

Systems and methods are provided for wide scan phased array fed reflector systems using ring-focus optics to significantly improve the scan volume of such systems. The subject system includes a reflector having a focal plane and a parabolic curvature configured to receive electromagnetic radiation having a first gain and provide reflected electromagnetic radiation having a second gain greater than the first gain that collimates into a focal ring. The subject system includes a feed array having feed elements positioned about the focal ring, in which each feed element is configured to receive the reflected electromagnetic radiation from the reflector and collimate the reflected electromagnetic radiation into a scanned beam for scanning an annular region. In some aspects, the feed array is centered on the focal ring such that at least one feed element overlaps with the focal
(Continued)

ring and remaining feed elements are non-overlapping with the focal ring.

20 Claims, 11 Drawing Sheets

(51) Int. Cl.
*H01Q 21/20* (2006.01)
*H01Q 19/18* (2006.01)

(52) U.S. Cl.
CPC ..... *H01Q 19/175* (2013.01); *H01Q 19/18* (2013.01); *H01Q 21/20* (2013.01)

(56) References Cited

U.S. PATENT DOCUMENTS 4,434,425 A * 2/1984 Barbano ..... H01Q 19/17 343/797
6,784,849 B2 8/2004 Benco
6,999,044 B2 * 2/2006 Durham ..... H01Q 3/2658 343/753
7,728,782 B2 * 6/2010 Watson ..... H01Q 3/28 343/840
9,054,414 B2 * 6/2015 Mizzoni ..... H01Q 15/147
9,373,896 B2 * 6/2016 Runyon ..... H01Q 3/30
10,665,955 B2 * 5/2020 Hirabe ..... H01Q 21/20
2006/0082513 A1 4/2006 Kralovec et al.
2009/0201213 A1 * 8/2009 Watson ..... H01Q 21/067 343/840
2012/0081266 A1 5/2012 Graber
2014/0327596 A1 11/2014 Darooka
2016/0359236 A1 12/2016 Sundaram

OTHER PUBLICATIONS

Fenn, A.J., et al., "Design and Analysis of an Axisymmetric Phased Array Fed Gregorian Reflector System for Limited Scanning," 2016 IEEE international Symposium on Phased Array Systems and Technology (PAST), Oct. 2016.
Prata, Jr., A., et al., "Displaced-Axis-Ellipse Reflector Antenna for Spacecraft Communications," Proceedings of the 2003 SBMO/IEEE MTT-S International Microwave and Optoelectronics Conference—IMOC 2003, pp. 391-395, Sep. 2003.
International Search Report and Written Opinion from PCT/US18/66584, dated Mar. 1, 2019, 9 pages.
European Extended Search Report, dated Aug. 9, 2021.
Ma Chao et al., "Subreflectarrays for Ring-Focus Reflector Antenna" 2017 10$^{th}$ Global Symposium on Millimeter-Waves, IEEE, May 24, 2017, pp. 137-139.

* cited by examiner

WIDE SCAN PHASED ARRAY FED REFLECTOR SYSTEMS

CROSS-REFERENCE TO RELATED APPLICATIONS

The present application claims the benefit of priority under 35 U.S.C. § 119 from U.S. Provisional Patent Application Ser. No. 62/607,864 entitled "IMPROVED SCAN PERFORMANCE PHASED ARRAY FED REFLECTORS," filed on Dec. 19, 2017, the disclosure of which are hereby incorporated by reference in their entirety for all purposes.

STATEMENT REGARDING FEDERALLY SPONSORED RESEARCH OR DEVELOPMENT

Not applicable.

FIELD

The present disclosure generally relates to antenna systems, and more particularly, to wide scan phased array fed reflector systems.

BACKGROUND

Antenna designs using Direct Radiating Arrays (DRAs) can provide wide scan and wide band performance for properly selected element types and grid spacings. The primary limitation associated with direct radiating array architectures is that, for a large gain and wide scan, the radiating aperture requires numerous elements, and an exceptionally large aperture. This requires a substantial increase in the prime power needed to operate the array (assuming elemental amplifiers and time delay/phase shifters), as well as increases to the overall weight, size envelope, and cost.

SUMMARY

The subject technology is related to phased array fed reflectors implemented with ring focus optics. By placing the feed array concentric with the focal ring of a ring-focus reflector system, increasing the number of radiating elements of the feed array in the radial direction about the focal ring can significantly improve the scan performance (e.g., increase the scan volume of the system to a range of 20-30 degrees by minimizing the de-focusing loss as the system is scanned off axis) when compared to a conventional PAFR, which can typically only achieve a scan volume of several degrees (e.g., less than 5 degrees). The subject technology permits the active array feed for the ring-focus PAFR to be significantly smaller, lower power, and less complex than a direct radiating array that would be needed to meet the same performance requirements.

In one embodiment of the subject technology, an optical system includes a reflector having a focal plane and a parabolic curvature configured to receive electromagnetic radiation having a first gain and provide reflected electromagnetic radiation having a second gain greater than the first gain that collimates into a focal ring. The optical system includes a feed array comprising a plurality of rings, in which each of the plurality of rings includes a plurality of feed elements configured to receive the reflected electromagnetic radiation from the reflector and collimate the reflected electromagnetic radiation into a scanned beam for scanning about an annular or conical volume. In some aspects, the feed array is centered on the focal ring such that at least one of the plurality of rings overlaps with the focal ring and remaining rings of the plurality of rings are non-overlapping with the focal ring.

In one embodiment of the subject technology, a method includes receiving electromagnetic radiation having a first gain at an incident angle on a radiating surface of a reflector having a radiating surface with a parabolic curvature. The method includes providing reflected electromagnetic radiation having a second gain greater than the first gain from the radiating surface of the reflector. The method includes collimating the reflected electromagnetic radiation into a focal ring about an axis of the reflector. The method also includes producing a scanned beam for scanning an annular region from the collimated electromagnetic radiation using a feed array centered on the focal ring, where the feed array includes a plurality of feed elements arranged in a plurality of rings. In some aspects, the reflected electromagnetic radiation being collimated by at least one ring of the plurality of rings that is overlapping with the focal ring and at least one ring of the plurality of rings that is non-overlapping with the focal ring.

In one embodiment of the subject technology, an antenna system includes a main reflector having a parabolic curvature configured to receive electromagnetic radiation having a first gain and provide reflected electromagnetic radiation having a second gain greater than the first gain that collimates into a focal ring. The antenna system also includes a plurality of feed antennas arranged in a ring. In some aspects, each of the plurality of feed antennas being disposed in a focal plane of the reflector. In other aspects, each plurality of feed antennas configured to receive first reflected electromagnetic radiation and second reflected electromagnetic radiation from the reflector and collimate the first reflected electromagnetic radiation and second reflected electromagnetic radiation into a scanned beam for scanning an annular region. In some aspects, the first reflected electromagnetic radiation is on-axis with a boresight and the second reflected electromagnetic radiation is off-axis with the boresight.

DETAILED DESCRIPTION

Figure 1A:
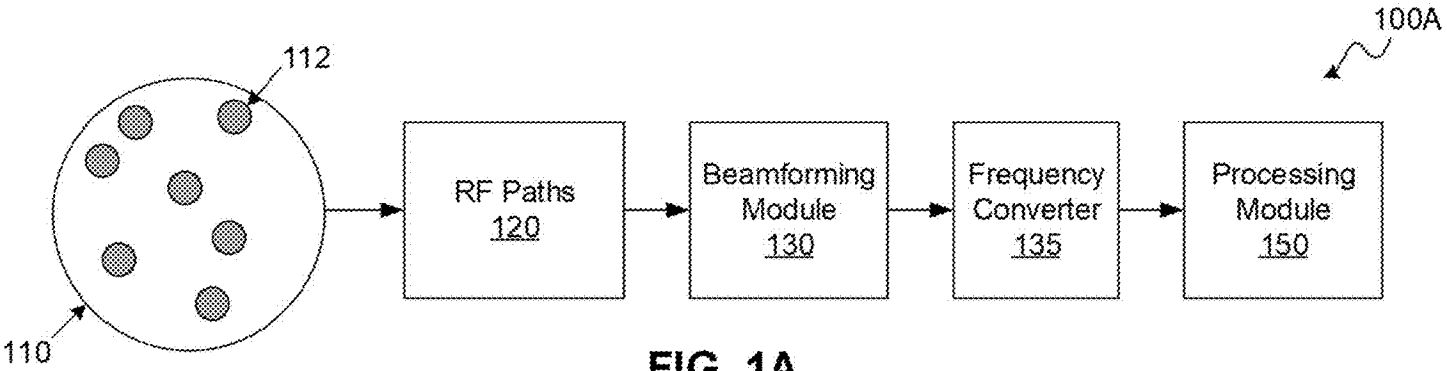
FIGS. 1A and 1B illustrate a conceptual diagram and implementation blocks of an example satellite receiver system according to one or more implementations of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced using one or more implementations. In one or more instances, well-known structures and components are shown in block diagram form in order to avoid obscuring the concepts of the subject technology.

The problem of wide scan, wide band performance is conventionally implemented using DRAs. The main problem with the DRA approach is that, for a large gain requirement, the radiating aperture needs to be exceptionally large physically. This requires a substantial increase in the prime power and integrated circuit (IC) component count needed to operate the array, as well as increases to the overall weight, size envelope, and cost. Antenna designs using PAFRs provide a compromise between reflectors and DRAs. PAFRs provide many of the performance benefits of DRAs while utilizing much smaller, lower cost feed arrays. The primary limitation associated with PAFR architectures is achievable scan volume.

The subject technology provides for addressing the problem of size, weight, power, and cost associated with conventional direct radiating antenna arrays. It also addresses scan volume and bandwidth of conventional PAFR architectures, which can typically only achieve a scan volume of several degrees over a narrow frequency bandwidth. The subject technology overcomes the limitations of conventional PAFRs by employing ring focus reflector optics fed by active phased arrays to achieve a much wider scan volume over a larger bandwidth.

The ring-focus PFRA architecture provides advantages over the DRA approach for certain scenarios requiring an annular scan volume. This is because, for a given gain and scan volume requirement, the active array can be significantly smaller and less complex for the ring-focus PAFR than it is for the DRA. The subject technology provides the agility of the DRA approach with less power (e.g., at ½ or ⅒th of the DRA prime power) while achieving the high gain performance of a reflector system. The active array is placed on the focal ring of the main reflector in a single reflector configuration (or the shared focal ring of a dual-reflector system), and feeds the reflectors, which can be sized to provide the required gain. With the RFR approach, instead of collimating the reflected electromagnetic radiation into a single focal point, the reflector collimates the energy to a ring or disk (i.e., the active feeding array). The active feeding array can be many times smaller than a DRA and achieve the same gain as the DRA aperture would yield, thus resulting in reduced prime power required for the system and a substantial reduction in mass, size envelope, and cost. The nature of the ring-focus optics for a center fed system allows for a full 360-degree azimuth scan volume, and elevation scan volume dictated by the specifics of the ring focus optics.

In some aspects, the subject technology may be used in various markets, including for example and without limitation, space-based payloads, airborne radar systems, and ground-based radar systems, signal processing and communication, space technology and communications systems markets.

Figure 1B:
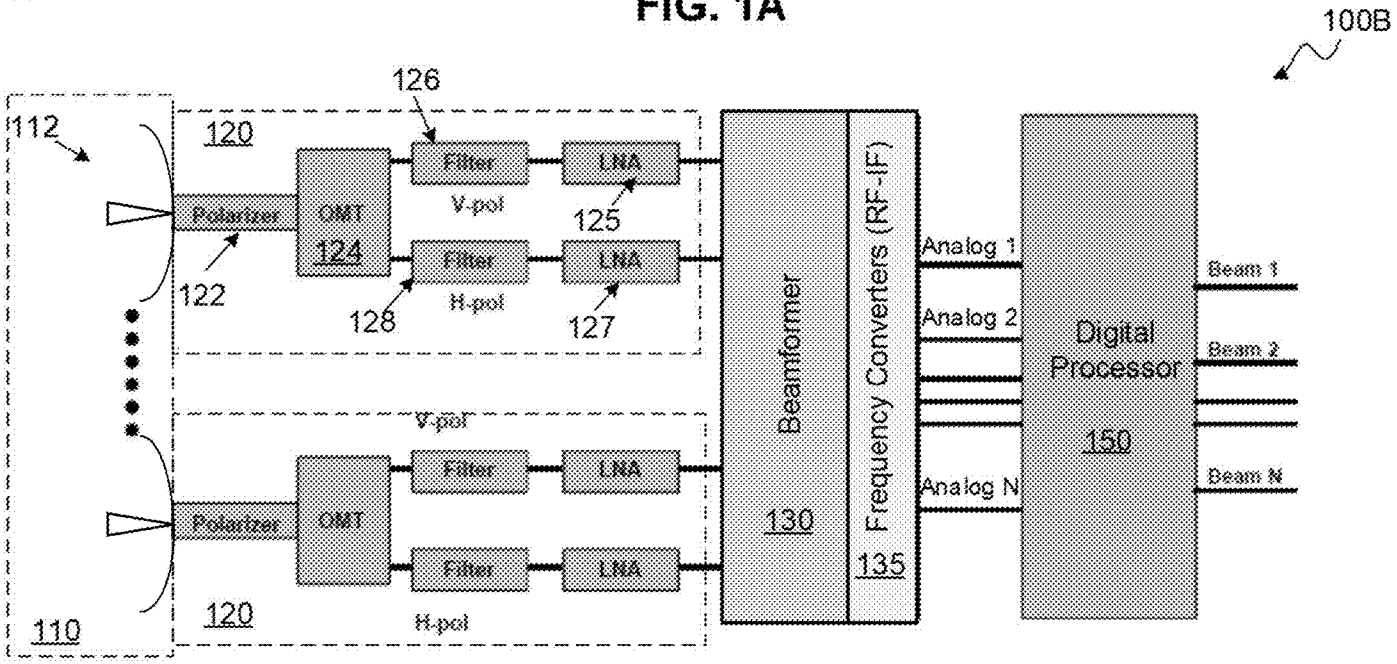

FIGS. 1A and 1B illustrate a conceptual diagram and implementation blocks of an example satellite receiver system according to some implementations of the subject technology. The example satellite receiver system 100A of FIG. 1A is onboard a satellite (e.g., a communication satellite) and can receive signals from multiple (e.g., N, such as five) uplink sites. The satellite receiver system 100A includes an antenna array 110, multiple RF paths 120, a beamforming module 130, a frequency converter 135, and a processing module 150.

The antenna array 110 includes multiple antenna elements 112. The radio-frequency (RF) signals from antenna elements 112 are prepared in elemental RF paths (hereinafter "RF paths") 120 to be processed by the beamforming module 130. The antenna array 110 may be designed by optimizing the aperiodic locations of the array-element configuration to generate low-level grating lobes for any beam pointing inside the desired coverage area of the scanned beams. Each optimization can be performed with a fixed number of elements. The optimization may be repeated for arrays with various element numbers to find the optimal cost-performance solution. The array element size may be selected such that a scan loss less than approximately 7-8 dB can be achieved over the coverage area. An example array antenna element 112 may include a parabolic reflector fed by a ring-based feed array.

In some implementations, the beamforming module 130 generates a number of RF analog signals. In one or more implementations, the frequency converter 135 converts the RF analog signals to intermediate frequency (IF) analog signals. In some aspects, the processing module 150 uses the IF analog signals to create respective beam signals for processing.

The example satellite receiver system 100B of FIG. 1B shows features of the satellite receiver system 100A in more details. For example, the antenna array 110 is shown to include a number of ring focused PAFR antennas as the antenna elements 112. In one or more aspects, each antenna element 112 may be a parabolic reflector fed by a ring-based feed array with improved performance including wider scan volume and wider bandwidth.

In some aspects, the antenna array 110 may receive right-hand and left-hand circularly polarized orthogonal signals, and each of the RF paths 120 may be coupled to an antenna element 112 and includes known components such as a polarizer 122, an ortho-mode transducer (OMT) 124, a first polarization receive chain including a first polarization filter 126 and a low-noise amplifier (LNA) 125, and a second polarization receive chain including a second polarization filter 128 and an LNA 127. The polarizer 122 converts the circularly polarized signals received from the horn antenna 112 to linearly polarized signals, and the OMT 124 separates the two resulting linearly polarized signals from one another. Each of the first and the second polarization signals can be filtered (e.g., using the first polarization filter 126 or the second polarization filter 128) and amplified (e.g., using the LNA 125 or the LNA 127) in the separate first and second polarization receive chains to generate signals corresponding to a frequency band of two sub-octave bands (e.g., 14.5-26.5 GHz (Low) or 26.5-51 GHz (High)). In some aspects, where the antenna array 110 receives two orthogonal linearly polarized signals, the RF paths 120 are similar and the polarizer 122 is not needed.

The beamforming module (e.g., beamformer) 130 uses the RF signals received from the RF paths 120 to generate RF analog signals (e.g., beams), which after conversion to IF by the frequency converters 135 provides IF analog signals (hereinafter "analog signals", such as Analog 1 to Analog N), where N corresponds to the count of uplink sites. In case an uplink site uses both polarizations, the beamformer 130 generates dual-polarized beams for that uplink site.

In some implementations, the beamformer 130 is a known block, for example, implemented by phase shifters or time delay units, and attenuation control components, and may help reject partially an interferer signal from the beam pointed to the intended signal uplink site at an earlier stage before the digital processing module 150. In some aspects, the processing module 150 uses the analog signals (e.g., Analog 1 to Analog N of FIG. 1B) to create one or more composite signals (e.g., N signals, one per intended uplink site) which correspond to one or more composite beams.

Figure 2:
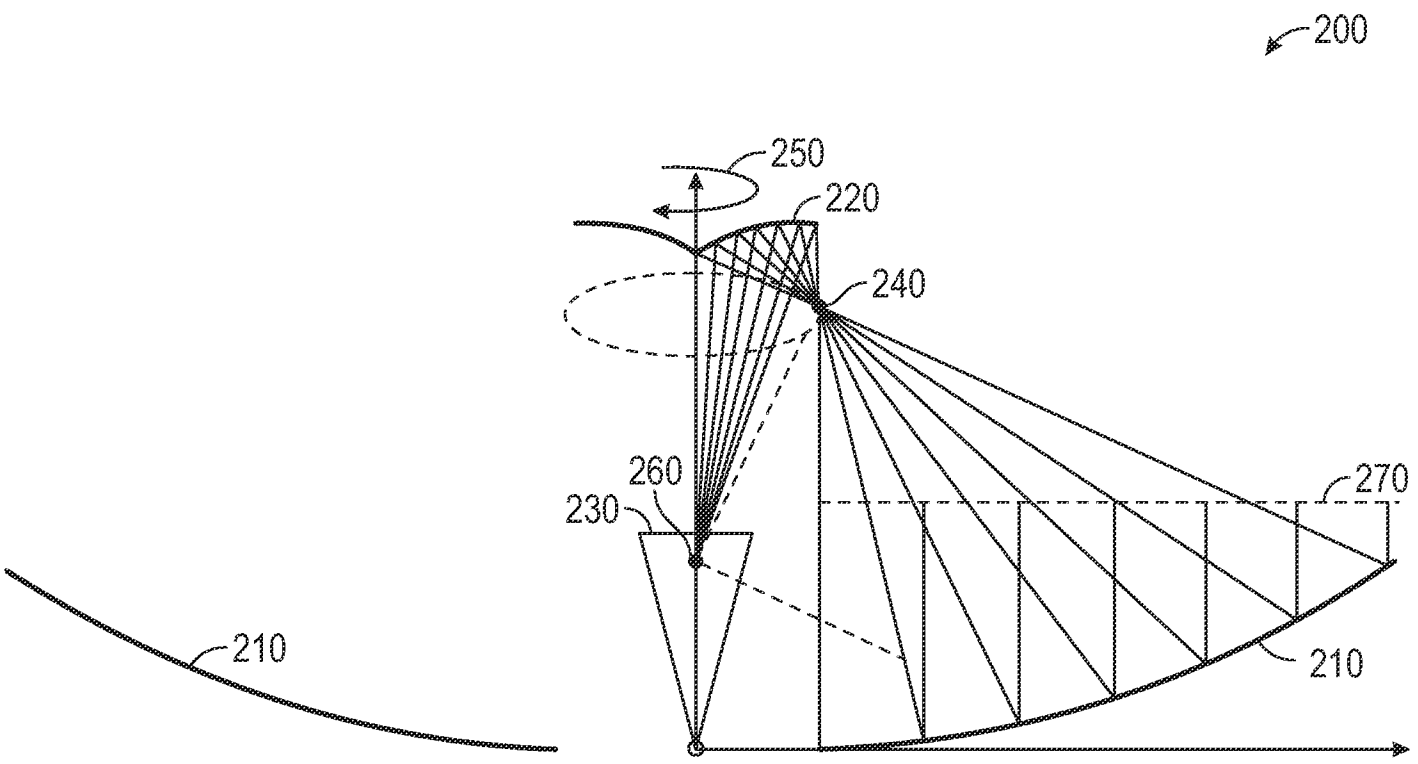
FIG. 2 (Prior Art)
FIG. 2 is a conceptual diagram illustrating an example of an antenna system using a ring-focus reflector according to some implementations of the subject technology.

FIG. 2 is a conceptual diagram illustrating an example of an antenna system 200 having a conventional ring focus optics system using a conventional feed horn according to some implementations of the subject technology. The ring-focus reflector (RFR) shown in FIG. 2 is the conventional state of the art PAFR having a center-fed dual-reflector architecture that focuses a plane wave to a focal point (e.g., 260). An axially displaced ellipse (ADE) is part of the family of RFRs shown in FIG. 2, which features axial symmetry of main and sub-reflectors. Conventional ADEs are generally fed by horns or small horn clusters. A direct center-fed PAFR architecture, such as that shown in FIG. 2, can employ a single parabolic reflector to allow high gain receive collimation/focusing of spherical wave energy from a plane wave 270 (i.e. antenna beam) to a focal point 260 (i.e. feed). The PAFR architectures can employ an additional (secondary) hyperbolic reflector (e.g., 220), which allows for repositioning of the feed. The antenna system 200 includes a main reflector 210 that is an offset paraboloid of revolution and a sub-reflector 220 that is a tilted ellipse of revolution. The antenna system 200 has a single focal ring shared by the main reflector 210 and the sub-reflector 220. However, the antenna system 200 does not provide wide scan performance.

The main reflector 210 is produced by spinning an offset section of a parabola about the antenna axis of symmetry (e.g., 250). This creates the main reflector 210 with the ring caustic (e.g., 240) shown in FIG. 2. To illuminate the main reflector 210, the sub-reflector 220 with a coinciding ring caustic and a focus (the system focus) is achieved starting with a displaced section of an ellipse with tilted axis and inter-focal distance, and spinning this ellipse about the antenna axis of symmetry. The sub-reflector 220 has a pointed vertex that directs the feed 230 radiation along the antenna axis towards the main reflector 210 rim. This illumination of the main reflector central region comes from the feed 230 rays that reflect near the sub-reflector 220 rim, which also stay away from the region occupied by the feed 230 aperture. As depicted in FIG. 2, electromagnetic radiation interacts with a radiating surface of the main reflector 210 at a normal incident angle at boresight, is reflected off the main reflector 210 and collimates into the ring caustic 240 of a focal ring centered about the axis of the main reflector 210. The collimated energy passes through the focal ring and reflects off the sub-reflector 220, and focuses into a feed at the focal point 260.

Figure 3B:
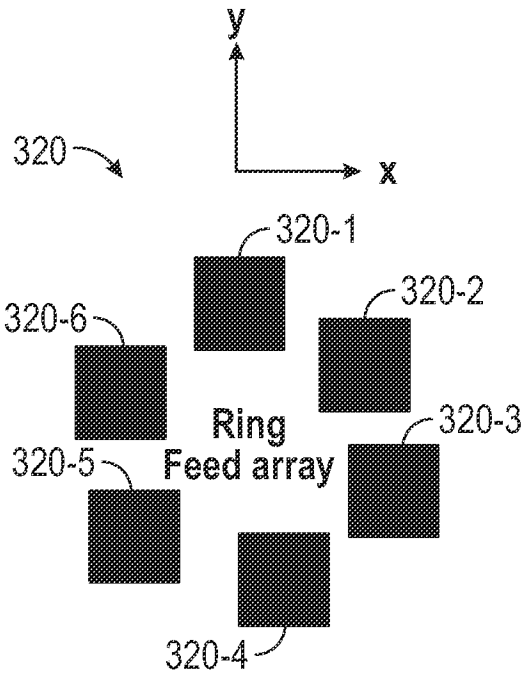
FIGS. 3A and 3B illustrate the geometry of an antenna system using a ring feed array according to one or more implementations of the subject technology.
Figure 3A:
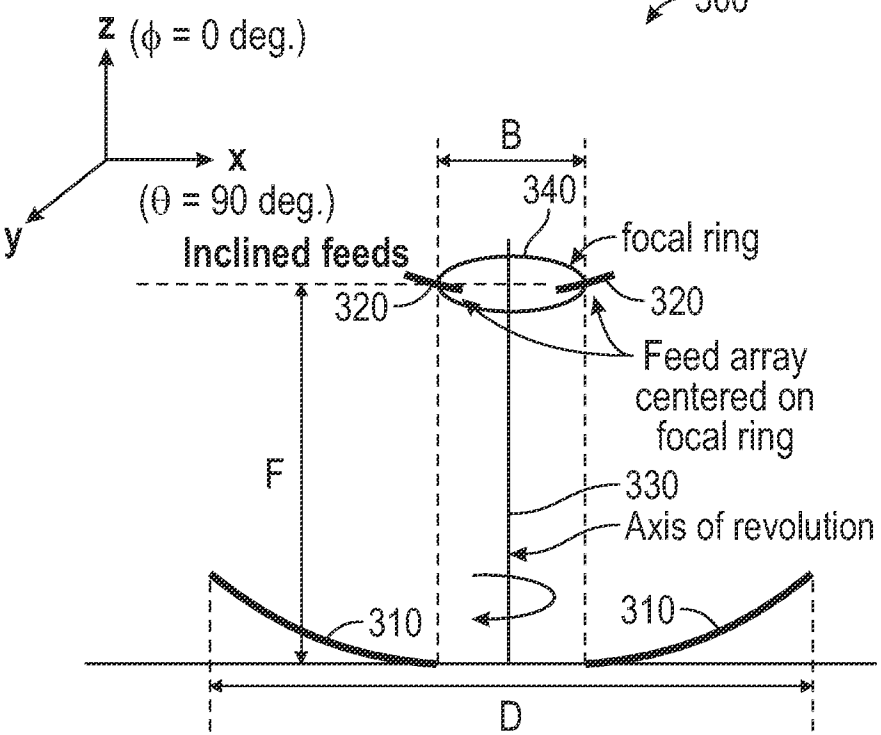

Turning to FIG. 3A, the geometry of an antenna system 300 according to one or more implementations of the subject technology is illustrated. The antenna system 300 is an example of an axially displaced paraboloid fed by a ring array, according to some aspects of the subject technology. The antenna system 300 includes a parabolic reflector 310 and a ring feed array 320 of feed elements disposed on an axis 330 of the parabolic reflector 310. The ring feed array 320 is formed by a number of inclined feed array elements centered on a focal ring 340. The feed elements of the ring feed array 320 are disposed such that each feed element is placed along the focal ring (e.g., 330) of the parabolic reflector 310 as every other feed element. The parabolic reflector 310 has a diameter D (e.g., 22.21 in), and the focal plane is located a focal distance F (e.g., 22.20 in) from the parabolic reflector 310.

As depicted in FIG. 3A, the antenna system 300 corresponds to a parabolic ring-focus reflector (PRFR) fed by the ring feed array 320 having F/D ratio of about 1 that produces a pencil beam scanned over an annular region. The antenna system 300 can scan a pencil beam over a wide angular swath (e.g., ±15-degree to ±20-degree scan in theta) and obtain very little scan loss (e.g., 3-4 dB scan loss) compared to what a conventional reflector system can achieve. The main paraboloid axis (e.g., 330) is not tilted such that the beam scan volume can be centered around the boresight (e.g., axis 330). The ring feed array 320 elements are modeled as ideal radiators with patterns analyzed at a frequency f=11.802 GHz, which corresponds to a wavelength $\lambda$=1 in. The array was scanned in $\varphi$=0-degree plane and scan loss was less than 7 dB for a 5-degree scan. Feed blockage effects are not considered but may impact scan performance. In some aspects, the main parabola axis can be tilted to a placed centroid of an annular field-of-view (FOV) at a desired location.

FIG. 3B illustrates the ring feed array 320 in more detail. The ring feed array 320 includes a ring of six electrically large ($3\lambda\times3\lambda$) elements (e.g., 320-1, 320-2, 320-3, 320-4, 320-5, 320-6) feeding the RFR. The feed elements are arranged along the x-y plane and centered about the focal ring 340.

Array weights can be optimized for maximum directivity for each scanned beam position. In a conventional array on a regular grid, direction cosines can be used to analytical determine the amplitude and phase weights on each feed element to scan the beam to a given element. In PAFR applications, the direction cosines may not be directly utilized for determining the amplitude and phase weights on each feed element as compared to working with DRAs. For a PAFR application, the phase and amplitude weights are optimized on each element based on the interaction with a main reflector and a sub-reflector (if present). In some implementations, each of the feed elements includes a phase shifter, which produces a uniform phase shift over a narrow frequency band. In other implementations, each feed element includes a true time delay device that provides a constant time delay over a wide frequency band, in which time and phase are related, where time is the frequency derivative of the phase response. In some aspects, the true time delay device includes transmission delays and switches that switch between shorter or longer transmissions lines to delay an RF signal some unit of time (e.g., 1 ps, 1 ns).

As used herein, the term "directivity" refers to the maximal value of the directive gain for an antenna. In other words, it is a measurement of the degree to which radiation emitted by an antenna is concentrated in a single direction. In comparison, modest scan performance is achieved due to only having one element in the radial direction.

The number of feed array elements in the radial direction about the focal ring 240 can impact scan performance, for example, by adding additional feed elements in the radial direction decreases the scan loss. In antenna systems, especially active phased arrays, the main driver for power and power density are the low noise amplifiers (LNAs), high power amplifiers (HPAs), beamforming integrated circuits (BFICs), etc., where these elements are spaced very closely together for a given aperture area at the higher frequencies, it is an objective to keep DC power low so that an entire payload is reasonable in terms of power and power density, given the very limited power budget to draw from a system in a space application. Although the ring feed array 320 is depicted with a radial ring arrangement, the ring feed array 320 can include other arrangements, such as a square grid arrangement, a rectangular grid arrangement, or a sparse grid arrangement, depending on implementation.

Each feed element is a wideband modular grid-shaped unit cell element. Since each feed element is disposed a same distance in wavelengths from a focal point of the parabolic reflector 310, however, the phase center of each feed element remains the same number of wavelengths distant from the focal ring, allowing for wide instantaneous bandwidth and wide scan volume with minimal scan loss.

The location of the ring feed array 320 is fixed in relation to the parabolic reflector 310, so that when the phase centers of the feeds move, the resultant phase error is automatically incorporated into the secondary patterns and gain. In some aspects, the size of the reflector 310 dictates the achievable the gain at a given frequency with high efficiency. This design allows the antenna system 300 to be geometrically frequency independent, as the phase center of each feed element is at a constant offset (in wavelengths) from the center of the ring feed array 320 (e.g., virtual location centrally located inside ring). According to one aspect of the subject technology, the location of the ring feed array 320 may be centered about the focal ring of the parabolic reflector 310. According to another aspect of the subject technology, the location of the ring feed array 320 may be offset from the focal ring, however, defocusing the array phase center off the focal point can lead to large scan losses for most scan angles.

While the foregoing exemplary embodiment has been described with reference to the feed elements having modular grid-shaped substrates, the scope of the present disclosure is not limited to such an arrangement. Rather, as will be readily apparent to those of skill in the art, the subject technology has application to a wide variety of antenna systems, such as those employing wideband feed elements configured as a linearly polarized log periodic dipole antenna ("LPDA"), a dual polarized sinuous antenna, or a dual polarized crossed LPDA. Moreover, while the foregoing exemplary implementation has been described with reference to a parabolic reflector, the scope of the subject technology is not limited to such an arrangement. Rather, as will be apparent to those of skill in the art, other reflector designs may also be used.

Figure 4C:
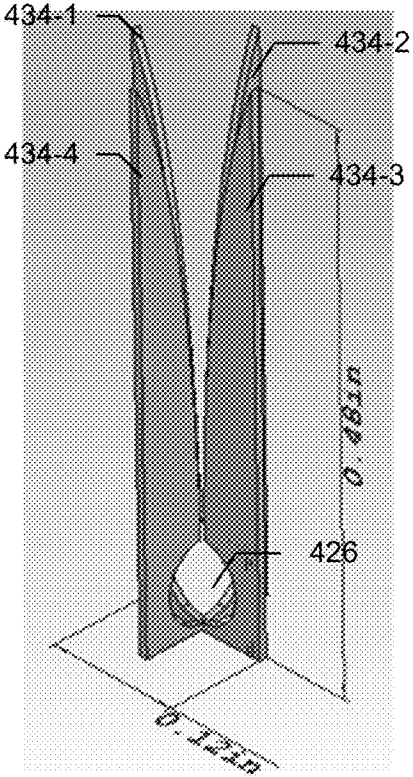
FIGS. 4A-4C illustrate examples of feed elements for a feed array in greater detail in accordance with some implementations of the subject technology.
Figure 4B:
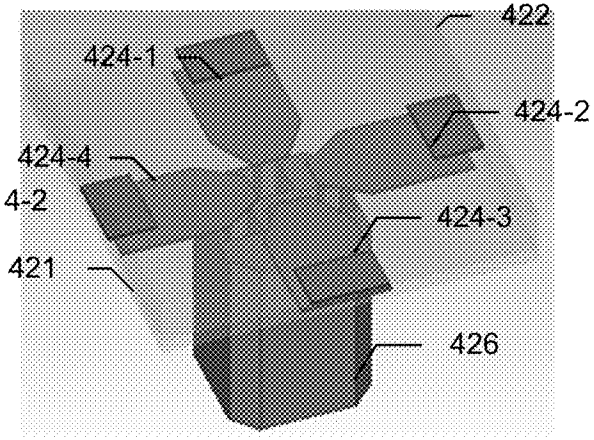
Figure 4A:
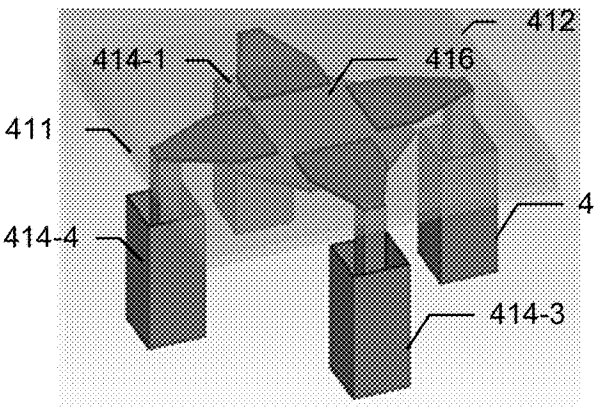

FIGS. 4A-4C illustrate examples of feed elements for a feed array (e.g., 320) in greater detail in accordance with some implementations of the subject technology. Key tradeoffs for consideration in implementing the radiating elements include manufacturability and modularity, voltage standing wave ratio (VSWR), and total scan loss, where manufacturability is the most significant tradeoff to consider in the elemental design of the radiating feed element.

Turning to FIG. 4A, a schematic diagram of an example of a radiating feed element 410 in a first configuration is illustrated. The radiating feed element 410 includes an antenna that is made of dielectric and metal layers formed on conventional printed circuit board material. As depicted in FIG. 4A, the radiating feed element 410 includes four columnar structures (e.g., 414-1, 414-2, 414-3, 414-4) with respective individual contact structures arranged orthogonal to the columnar structures. The contact structures are coupled to a center contact structure 416 at a bottom surface of a first substrate 411. At Ka-band, the width of the center contact structure 416 may be about 0.07 in. The length of each side of the substrates (e.g., 411, 412) may be about 0.15 in. In some aspects, the radiating feed element 410 includes a second substrate 412 of a greater thickness (e.g., 15 mil thick) than the first substrate 411 (e.g., 5 mil thick), and is stacked on top of the first substrate 411. The radiating feed element 410 can be optimized for match over a wide, multi-octave frequency band in the range of 14.5 GHz to 51 GHz. The radiating feed element 410 has VSWR minimized, where the VSWR is less than 0.6 dB across the frequency band, less than 2:1 ratio at boresight, and less than 3.7:1 ratio at 60-degree scan.

FIG. 4B illustrates a schematic diagram of an example of a radiating feed element 420 in a second configuration. The radiating feed element 420 includes an antenna that is made of polystrata layers formed on conventional printed circuit board material. As depicted in FIG. 4B, the radiating feed element 420 includes one columnar structure (e.g., 426) having four annular structures contained therein. The annular structures are coupled to respective individual contact structures (e.g., 424-1, 424-2, 424-3, 424-4) arranged orthogonal to the columnar structure 426. The contact structures (e.g., 424-1, 424-2, 424-3, 424-4) are coupled to a bottom surface of a first substrate 421 formed of the polystrata layers. In some aspects, the radiating feed element 420 includes a second substrate 422 of a greater thickness (e.g., 15 mil thick) than the first substrate 421 (e.g., 5 mil thick), and is stacked on top of the first substrate 421. In some aspects, the radiating feed element 420 includes additional contact structures interposed between the first substrate 421 and the second substrate 422. However, the radiating feed element 410 provides an advantage over the radiating feed element 420 in terms of being easier to integrate into multiple subarrays without connection dependency on the perimeter elements of each subarray.

FIG. 4C illustrates a schematic diagram of an example of a center-fed Vivaldi antenna feed element 430. The Vivaldi antenna 430 is a co-planar broadband antenna, which can be made from a solid piece of sheet metal, a printed circuit board, or from a dielectric plate metalized on one or both sides. As depicted in FIG. 4C, the Vivaldi antenna 430 includes four orthogonally-arranged shear-shaped panels (e.g., 434-1, 434-2, 434-3, 434-4) that form an open space 432 near a bottom region of each panel. The feeding line excites the open space 432 via a microstrip line or coaxial cable, and may be terminated with a sector-shaped area or a direct coaxial connection. The Vivaldi antenna can be made for linear polarized waves or—using two devices arranged in orthogonal direction—for transmitting/receiving both polarization orientations. If fed with 90-degree phase-shifted signals, orthogonal devices can transmit/receive circular-polarized electromagnetic waves. In some aspects, the height of the Vivaldi antenna 430 is about 0.48 in and the width is about 0.12 in (e.g., Ka-band implementation).

Figure 5B:
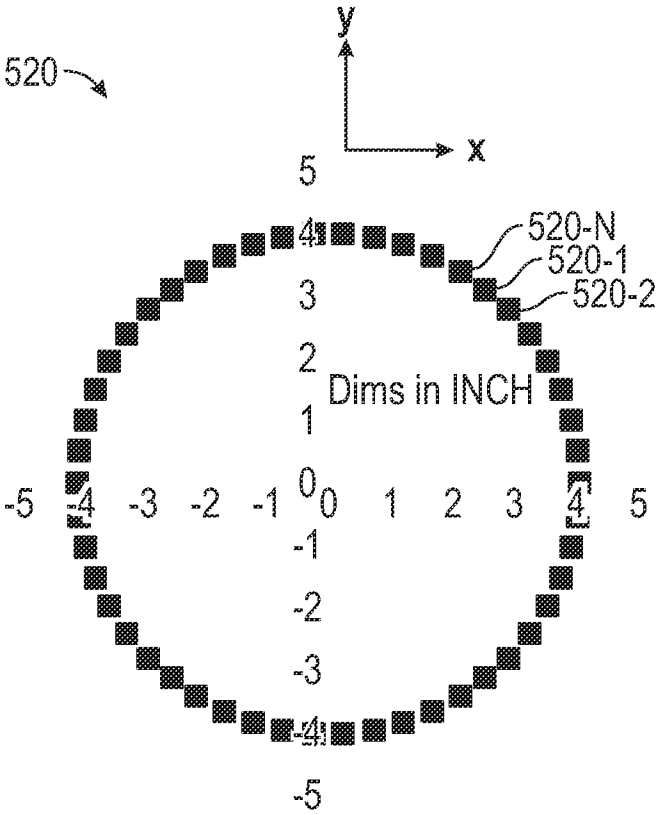
FIGS. 5A and 5B illustrate the geometry of an antenna system using a single-ring feed array according to one or more implementations of the subject technology.
Figure 5A:
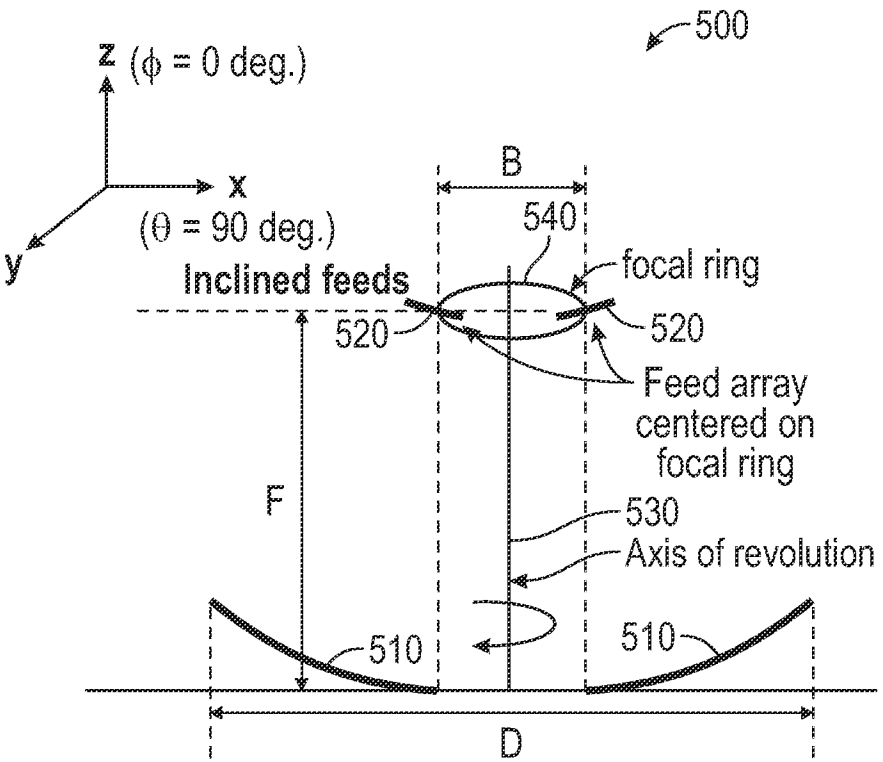

FIGS. 5A and 5B illustrate the geometry of an antenna system 500 using a single-ring feed array according to one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Turning to FIG. 5A, the antenna system 500 includes a PRFR fed by a ring array with F/D ratio of about 0.5 that produces a pencil beam scanned over an annular region. The antenna system 500 includes a parabolic reflector 510 and a ring feed array 520 of feed elements disposed on an axis 530 of the parabolic reflector 510. The ring feed array 520 is formed by a number of inclined feed array elements centered on a focal ring 540. The parabolic reflector 510 has a diameter D (e.g., 22.21 in), and the focal plane is located a focal distance F (e.g., 11 in) from the parabolic reflector 510 to achieve a F/D ratio of about 0.5. The boresight has a diameter of about 8.0 in.

The main paraboloid axis (e.g., 530) is not tilted such that the beam can be centered around the boresight. The ring feed array 520 elements are modeled as ideal radiators with patterns analyzed at a frequency f=23.604 GHz, which corresponds to a wavelength $\lambda$=0.5 in. The array was scanned in $\varphi$=0-degree plane and scan loss was less than 8 dB for a 5-degree scan. In this embodiment, decreasing the element size and increasing the feed element count compared to FIG. 5B may provide marginal improvements in scan loss or scan volume.

FIG. 5B illustrates the ring feed array 520 in more detail. The ring feed array 520 includes a ring of 50 electrically smaller ($1\lambda\times1\lambda$) elements (e.g., 520-1, 520-2, . . . , 520-N) feeding the RFR, where N=50. The feed elements are arranged along the x-y plane and centered about the focal ring 540. As depicted in FIG. 5B, the diameter of the focal ring 540 is about 8 in, but the diameter value is arbitrary and may vary depending implementation.

While the parabolic reflector 510 in FIG. 5A has been illustrated as possessing a curvature for generating a quadratic phase distribution in a wavefront at an aperture plane, the scope of the subject technology is not limited to such an arrangement. Rather, the subject technology may have application to reflectors with non-parabolic curvature to generate one or more non-focused beams.

While due to the constraints imposed by schematic diagrams, the feed arrays in the exemplary embodiments described herein have been illustrated as including feed antennas arranged in a circular (or ring) fashion, the scope of the subject technology is not limited to such an arrangement. Rather, as will be apparent to one of skill in the art, the subject technology has application to antenna systems in which the feed arrays include feed antennas in any arrangement with ring-focus optics.

Figure 6B:
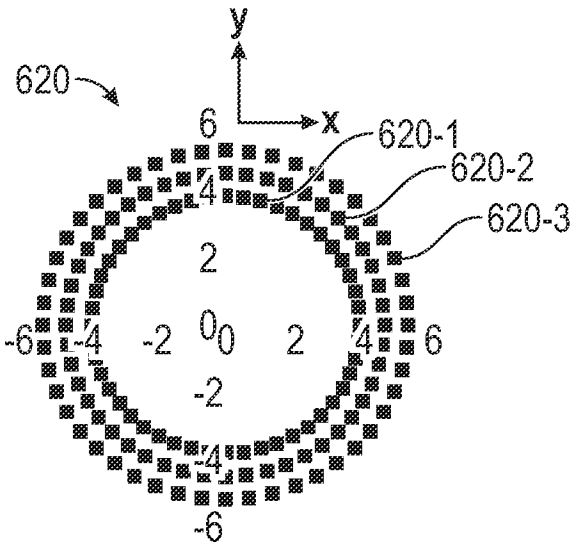
FIGS. 6A-6C illustrate the geometry of an antenna system using a multiple-ring feed array according to one or more implementations of the subject technology.
Figure 6C:
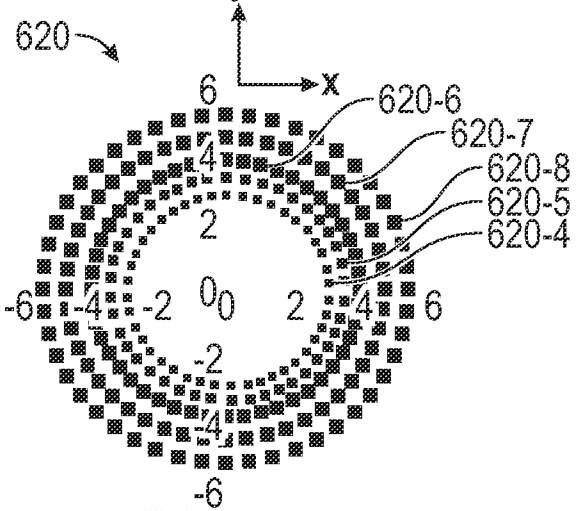
Figure 6A:
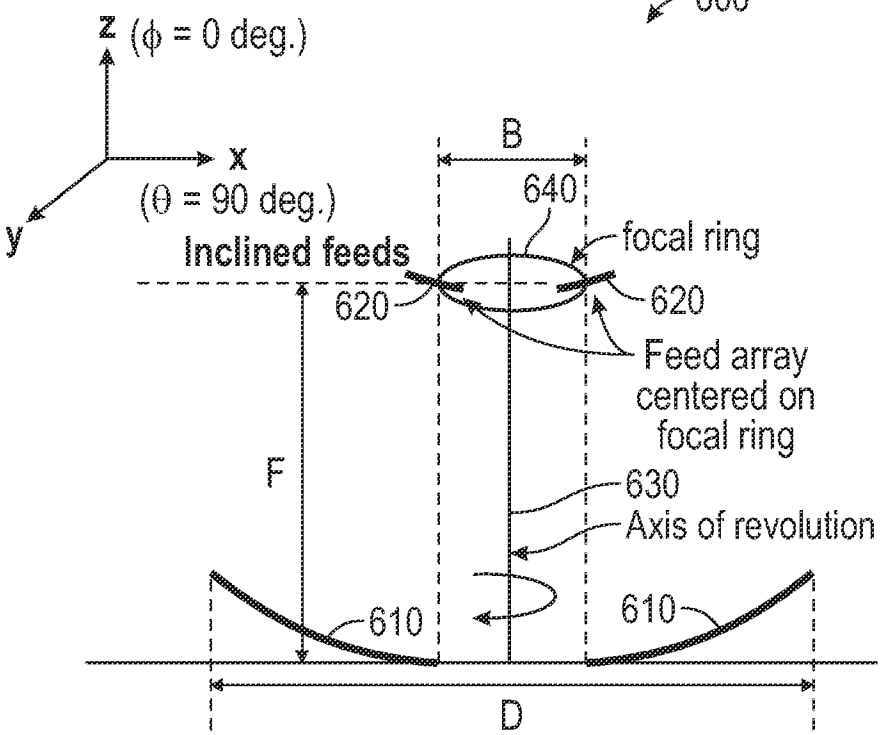

FIGS. 6A-6C illustrate the geometry of an antenna system 600 using a multiple-ring feed array according to one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Turning to FIG. 6A, the antenna system 600 includes a PRFR fed by a ring feed array 620 with F/D ratio of about 0.5 that produces a pencil beam scanned over an annular region. The antenna system 600 includes a parabolic reflector 610 and a ring feed array 620 of feed elements disposed on an axis 630 of the parabolic reflector 610. The ring feed array 620 is formed by a number of inclined feed array elements centered on a focal ring 640. The parabolic reflector 610 has a diameter D (e.g., 22.21 in), and the focal plane is located a focal distance F (e.g., 11 in) from the parabolic reflector 610 to achieve a F/D ratio of about 0.5. The boresight has a diameter of about 8.0 in. Similarly to FIG. 5A, the main paraboloid axis (e.g., 630) is not tilted such that the beam can be centered around the boresight.

While the foregoing exemplary embodiments have been illustrated and described with reference to feed arrays with a single radial ring of feed elements, the scope of the subject technology is not limited to such an arrangement. Rather, as will be apparent to those of skill in the art, the subject technology has application to implementations in which the feed arrays include multiple radial rings of feed elements, with or without a single central feed element. For example, FIG. 6B illustrates an exemplary embodiment in which the ring feed array 620 includes a first radial ring 620-1 of feed elements disposed about the focal ring 240, and a second radial ring 620-2 of feed elements disposed around the first radial ring 620-1, and a third radial ring 620-3 of feed elements disposed around the second radial ring 620-2. FIG. 6C illustrates yet another exemplary implementation, in which the ring feed array 620 includes a first radial ring 620-4 of feed elements disposed about the focal ring 240, and a second radial ring 620-5 of feed elements disposed around the first radial ring 620-4, a third radial ring 620-6 of feed elements disposed around the second radial ring 620-5, a fourth radial ring 620-7 of feed elements disposed around the third radial ring 620-6, and a fifth radial ring 620-8 of feed elements disposed around the fourth radial ring 620-7.

Turning to FIG. 6B, the ring feed array 620 having 6 radial rings (e.g., 620-1, 620-2, 620-3) of feed elements is illustrated. The 6-ring feed array 620 includes about 144 feed elements, but the number of elements is arbitrary based on the number of rings and may vary depending on implementation. In some aspects, the ring feed array 620 is centered on the focal ring 640 such that at least one of the square-grid rings (e.g., 620-2) of the ring feed array 620 overlaps with the focal ring 640 and the other square-grid rings (e.g., 620-1, 620-3) of the ring feed array 620 are non-overlapping with the focal ring 640. In this respect, a first subset of the square-grid rings (e.g., 620-1) are located inside the focal ring 640 diameter and a second subset of the square-grid rings (e.g., 620-3) is located outside of the focal ring 640 diameter.

Turning to FIG. 6C, the ring feed array 620 having 5 radial rings (e.g., 620-4, 620-5, 620-6, 620-7, 620-8) of feed elements is illustrated. The 5-ring feed array 620 has about 240 feed elements, but the number of elements is arbitrary based on the number of rings and may vary depending on implementation. In some implementations, the feed element size for the 5-ring feed array 620 is about 0.5 in×0.5 in. In some aspects, the ring feed array 620 is centered on the focal ring 640 such that at least one of the square-grid rings (e.g., 620-6) of the ring feed array 620 overlaps with the focal ring 640 and the other square-grid rings (e.g., 620-4, 620-5, 620-7, 620-8) of the ring feed array 620 are non-overlapping with the focal ring 640. In this respect, a first subset of the square-grid rings (e.g., 620-4, 620-5) are located inside the focal ring 640 diameter and a second subset of the square-grid rings (e.g., 620-7, 620-8) is located outside of the focal ring 640 diameter.

The ring feed array 620 elements are modeled as ideal radiators with patterns analyzed at a frequency f=23.604 GHz, which corresponds to a wavelength $\lambda$=0.5 in. The array was scanned in $\varphi$=0-degree plane and the beam peak is placed nominally at $\theta$=40°. The scan loss was less than 6 dB for a 55-degree scan with the 5-ring feed array implementation, whereas the 3-ring feed array implementation produced a scan loss of less than 5 dB for a 55-degree scan. In some aspects, both amplitude and phase weights on the individual feed elements are optimized for each scan angle.

By adding more feed elements in the radial direction about the focal ring (e.g., 240) helps mitigate scan losses due to de-focusing. For example, increasing the number of radial rings in the feed array significantly reduces scan loss and increases scan volume. This can be observed when a plane wave arrives at the radiating surface of the reflector 610 at boresight and at normal incidence, and the optics are ideal (e.g., no RMS error, the shapes are ideal), all of that incoming energy will focus or collimate into the focal ring 640. The focal ring 640 has a diameter associated with it, but the focal ring 640 has no thickness. When the incoming energy becomes de-focused or goes off boresight, that energy no longer collimates perfectly into the focal ring 610 and no longer maps perfectly with zero thickness, but rather, the focal ring 640 begins to thicken radially. In this respect, by having multiple radiating feed elements about the focal ring, the subject technology provides for collecting that energy that has been defocused on feed elements that are offset from the ideal focal ring that has zero thickness. When the focal ring 640 is thickened radially, the use of the multi-ring feed array is compensating for that defocusing effect that is present in the optical subsystem.

Figure 7B:
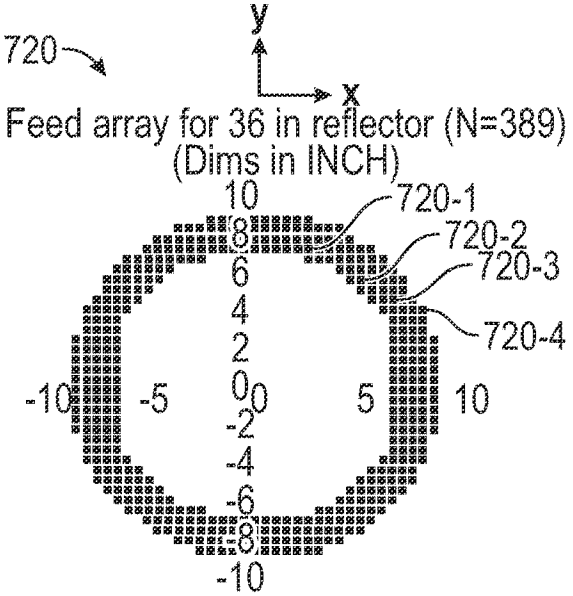
FIGS. 7A-7C illustrate the geometry of an antenna system using a multiple-ring feed array according to one or more implementations of the subject technology.
Figure 7C:
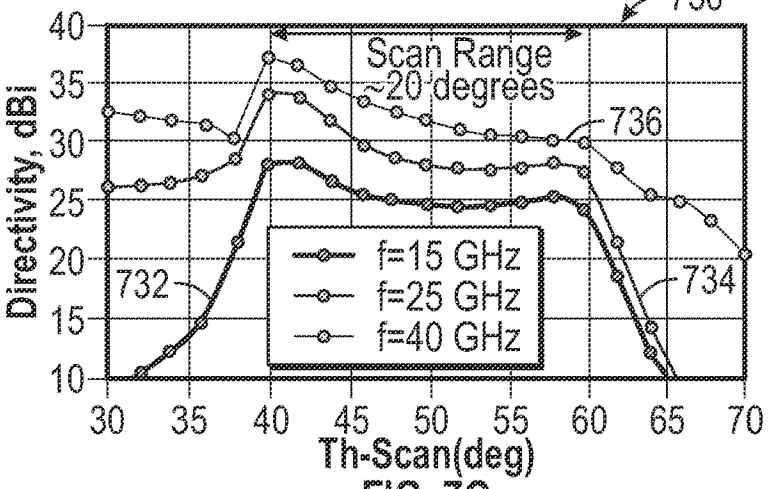
Figure 7A:
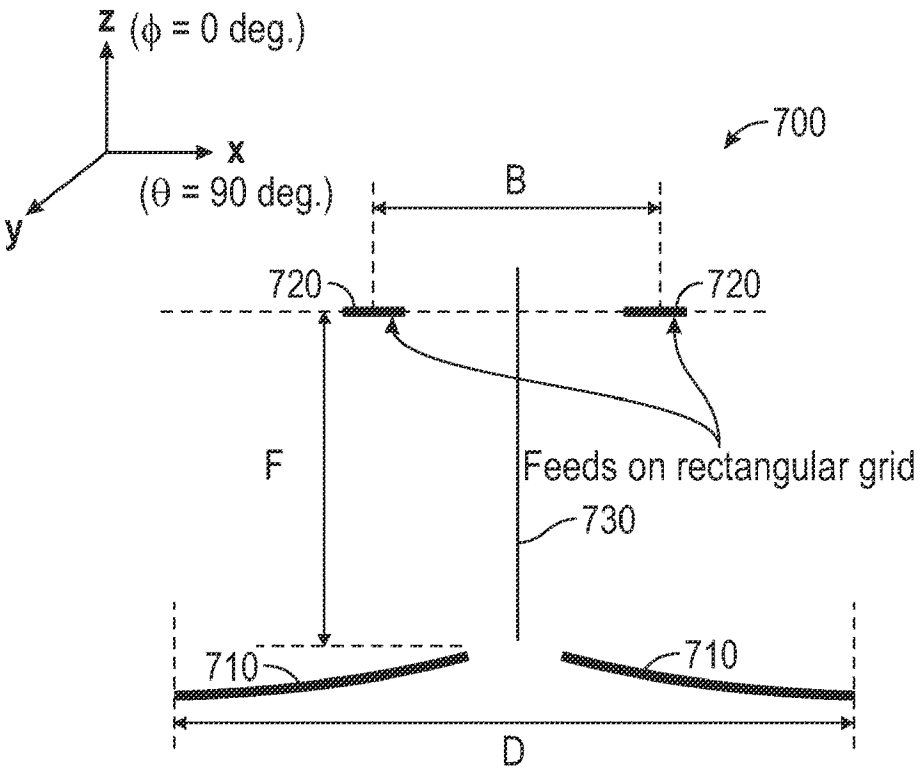

FIGS. 7A-7C illustrate the geometry of an antenna system 700 using a multiple-ring feed array according to one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Turning to FIG. 7A, the antenna system 700 includes a PRFR fed by a ring array with a square grid arrangement that produces a pencil beam centered at 50 degrees for scanning over an annular region. The antenna system 700 includes a parabolic reflector 710 and a ring feed array 720 of feed elements disposed on an axis 730 of the parabolic reflector 710. The parabolic reflector 710 has a diameter D (e.g., 36 in), and the focal plane is located a focal distance F (e.g., 37.52 in) from the parabolic reflector 710 inner rim. The boresight has a diameter of about 15.43 in. The main paraboloid axis is tilted 40 degrees from nominal for a 40-degree to 60-degree beam coverage, and the pattern performance is symmetric about $\varphi$.

FIG. 7B illustrates the ring feed array 720 in more detail. The ring feed array 720 feeds the 36" diameter RFR. The ring feed array 720 includes 389 feed elements arranged on a square arrangement of 0.5 in.×0.5 in. grid spacing, and amplitude and phase weights on the feed elements are optimized for each scan angle. The feed elements are arranged along the x-y plane and centered about a focal ring. In some aspects, the feed elements are non-inclined (e.g., level with the x-y plane). As depicted in FIG. 7B, the ring feed array 720 includes a first square-grid ring 720-1 of feed elements disposed about the axis 730, a second square-grid ring 720-2 of feed elements disposed around the first square-grid ring 720-1, a third square-grid ring 720-3 of feed elements disposed around the second square-grid ring 720-2, and a fourth square-grid ring 720-4 of feed elements disposed around the third square-grid ring 720-3. In some aspects, the ring feed array 720 is centered on the focal ring such that at least one of the square-grid rings (e.g., 720-3) of the ring feed array 720 overlaps with the focal ring and the other square-grid rings (e.g., 720-1, 720-2, 720-4) of the ring feed array 720 are non-overlapping with the focal ring. In this respect, a first subset of the square-grid rings (e.g., 720-1, 720-2) are located inside the focal ring diameter and a second subset of the square-grid rings (e.g., 720-4) is located outside of the focal ring diameter.

FIG. 7C illustrates a plot 730 depicting directivity waveforms over different scan angles for a multi-ring feed array in a rectangular grid arrangement. In plot 730, scan signal 732 provides a directivity range of 25-28 dB at an operating frequency of 15 GHz, scan signal 734 provides a directivity range of 27-35 dB at an operating frequency of 25 GHz, and scan signal 736 provides a directivity range of 30-37 dB at an operating frequency of 40 GHz. The amount of scan loss among the scan signals (e.g., 732, 734, 736) at degree locations with the highest gain values (e.g., centered about 40 degrees) is in a range of 8-10 dB, and the scan loss at degree locations with the lowest gain values (e.g., centered about 60 degrees) is in a range of 3-5 dB. In this regard, the scan range is about 20 degrees. This configuration as depicted in FIG. 7B provides improved scan volume performance compared to the feed array configurations depicted in FIGS. 3B and 5B.

Figure 8B:
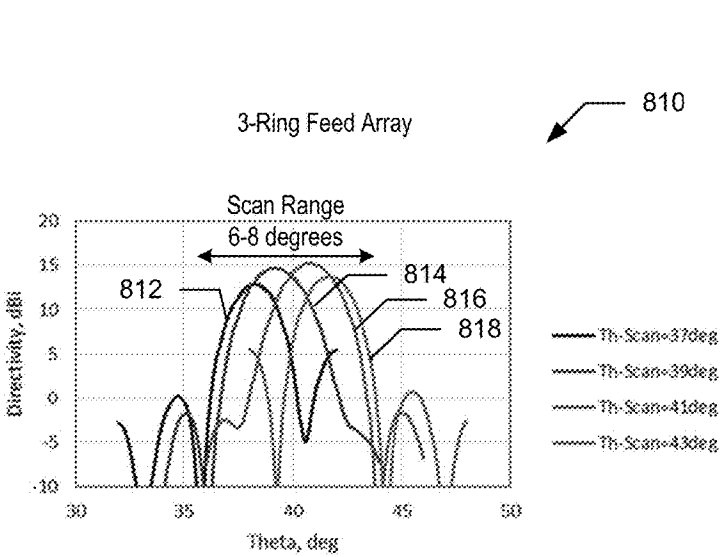
FIGS. 8A-8C illustrate an example of an annular beam formed by an antenna system using a multiple-ring feed array according to one or more implementations of the subject technology.
Figure 8C:
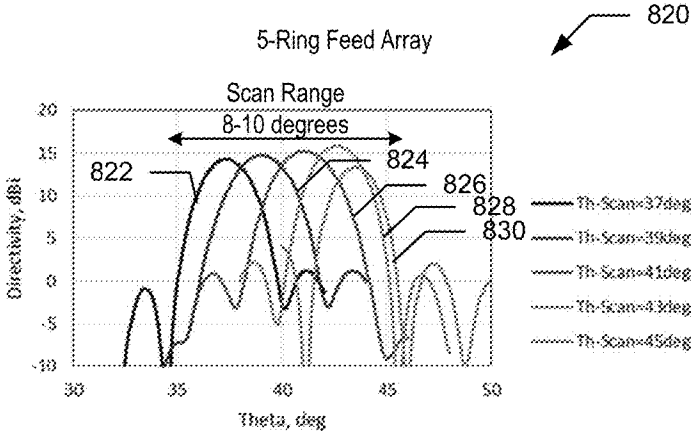
Figure 8A:
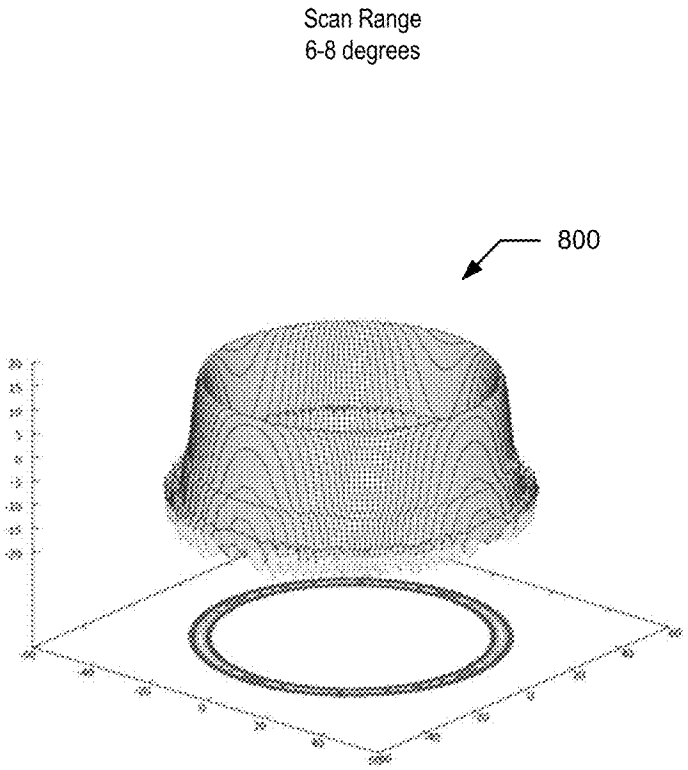

FIGS. 8A-8C illustrate an example of an annular beam 800 formed by an antenna system using a multiple-ring feed array according to one or more implementations of the subject technology. As depicted in FIG. 8A, a three-dimensional representation of an annular beam scanning about a nominal angle is illustrated. The feed grid is 0.5 in.×0.5 in. and patterns are generated at a frequency f=23.604 GHz, which corresponds to a wavelength $\lambda$=0.5 in., using two feed array sizes, a 3-ring feed array (about 144 feed elements) and 5-ring feed array (about 240 feed elements) about the RFR focal ring. It is observed that the scan performance improves with increasing the number of radial rings. For the 3-ring feed array, the scan range is about 6-8 degrees. For the 5-ring feed array, the scan range is about 8-10 degrees. Similar to the pencil beam implementations, improved scan performance of the annular beam is achieved with more radiated elements. When the amplitude and phase weights of the feed elements are optimized, the centroid of the annular region can be positioned. In some aspects, the centroid position can be adjusted in a radial direction (e.g., $\theta$). In this regard, the ring diameter of the annular beam can be seen growing or shrinking radially in $\theta$. In some implementations, a ring feed array and an antenna array shaped in a ring can produce the annular beam, where the main beam tends to mimic the shape of the aperture.

Turning to FIG. 8B, a plot 810 depicting directivity waveforms over different scan angles for a three-ring feed array is illustrated. In plot 810, scan signal 812 is centered around 37 degrees, scan signal 814 is centered around 39 degrees, scan signal 816 is centered around 41 degrees, and scan signal 818 is centered around 43 degrees. The amount of scan loss among the scan signals (e.g., 812, 814, 816, 818) at the centered degree locations is in a range of 2-3 dBi. In this regard, the scan range is about 6-8 degrees. FIG. 8C illustrates a plot 820 depicting directivity waveforms over different scan angles for a five-ring feed array. In plot 820, scan signal 822 is centered around 37 degrees, scan signal 824 is centered around 39 degrees, scan signal 826 is centered around 41 degrees, scan signal 828 is centered around 43 degrees, and scan signal 830 is centered around 45 degrees. The amount of scan loss among the scan signals (e.g., 822, 824, 826, 828, 830) at the centered degree locations is in a range of 2-3 dB. In this regard, the scan range is about 8-10 degrees.

Figure 9B:
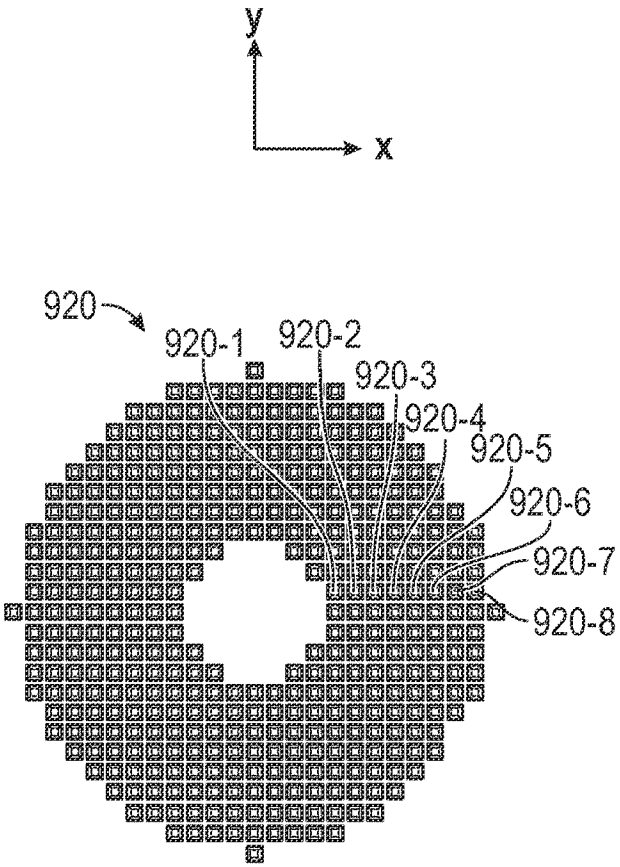
FIGS. 9A and 9B illustrate the geometry of an antenna system using dual reflectors and a ring feed array according to one or more implementations of the subject technology.
Figure 9A:
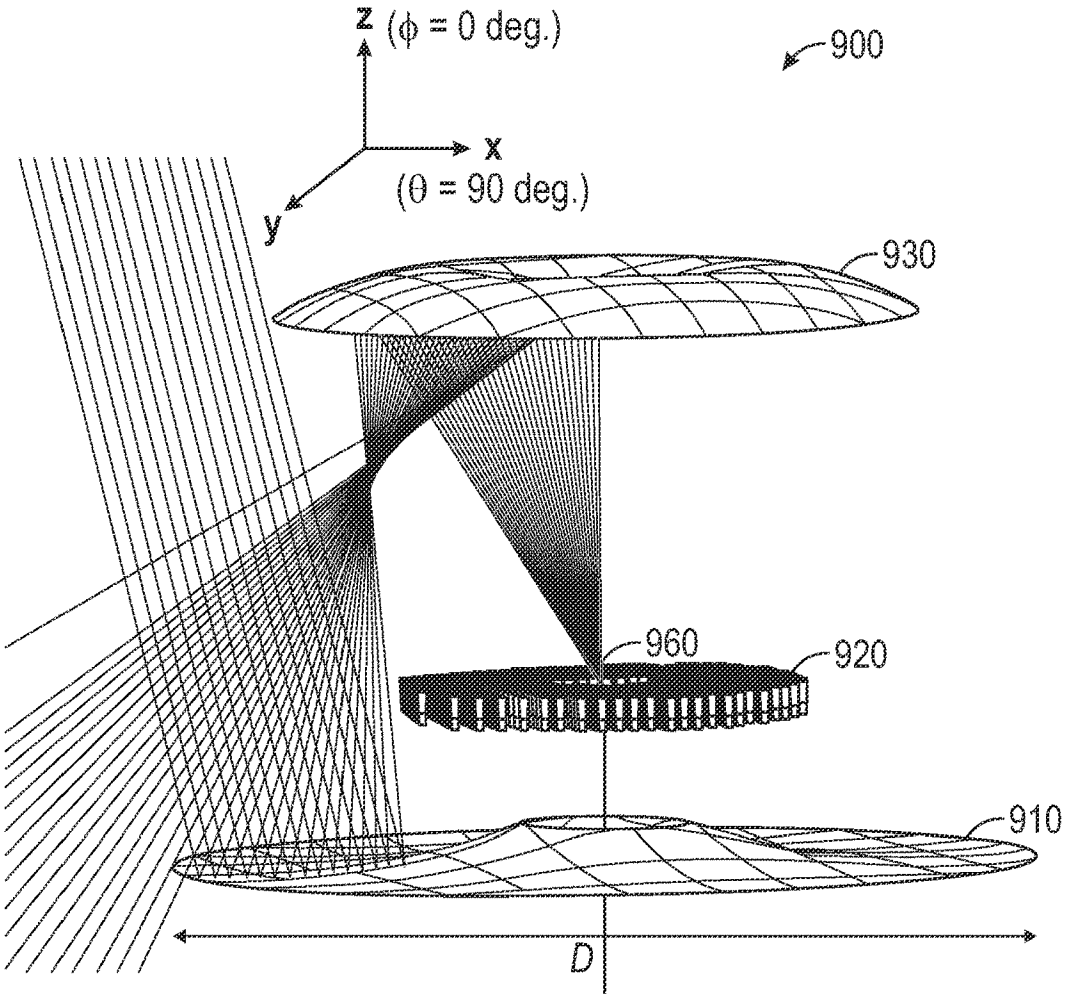

FIGS. 9A and 9B illustrate the geometry of an antenna system 900 using dual reflectors and a ring feed array 920 according to one or more implementations of the subject technology. Not all of the depicted components may be required, however, and one or more implementations may include additional components not shown in the figure. Variations in the arrangement and type of the components may be made without departing from the spirit or scope of the claims as set forth herein. Additional components, different components, or fewer components may be provided.

Turning to FIG. 9A, the antenna system 900 includes a PRFR fed by a ring array with a square grid arrangement that produces a pencil beam for scanning over an annular region. The antenna system 900 includes a main reflector 910 and a sub-reflector 930 that is a tilted conic (e.g., ellipse, parabola, or hyperbola) of revolution. The main reflector 910 has a diameter D (e.g., 1.0 m). The RFR shown in FIG. 9A is a center-fed dual-reflector architecture that focuses a plane wave to a focal point (e.g., 960). The antenna system 900 includes a ring feed array 920 of feed elements disposed on an axis of the main reflector 910. The sub-reflector 930 has a pointed vertex (and concave down) that directs the ring feed array 920 radiation along the antenna axis towards the main reflector 910 rim. The main paraboloid axis may be tilted 40 degrees from nominal for a 40-degree to 60-degree beam coverage, and the pattern performance is symmetric about φ. The sub-reflector 930 is a tilted conic (e.g., ellipse) of revolution and the main reflector 910 is a parabola of revolution. In some aspects, the antenna system 900 includes two focal rings, where the ring feed array 930 is planar with an upper focal ring (or first focal ring) and a lower focal ring (or second focal ring).

In operation, electromagnetic radiation travels along the incident plane toward the top surface of the main reflector 910 and interacts with the top surface of the main reflector 910 to produce first reflected electromagnetic radiation. The first reflected electromagnetic radiation interacts with the inner surface of the sub-reflector 930 to produce second reflected electromagnetic radiation. The second reflected electromagnetic radiation converges to a focal point (e.g., 960) and interacts with the feed elements of the ring feed array 920 to produce a pencil beam through the open center of the main reflector 910.

FIG. 9B illustrates the ring feed array 920 in more detail. The feed elements are arranged along the x-y plane and centered about a focal ring. In some aspects, the feed elements are non-inclined (e.g., level with the x-y plane). As depicted in FIG. 9B, the ring feed array 920 includes a first square-grid ring 920-1 of feed elements disposed about the main reflector axis, a second square-grid ring 920-2 of feed elements disposed around the first square-grid ring 920-1, a third square-grid ring 920-3 of feed elements disposed around the second square-grid ring 920-2, a fourth square-grid ring 920-4 of feed elements disposed around the third square-grid ring 920-3, a fifth square-grid ring 920-5 of feed elements disposed around the fourth square-grid ring 920-4, a sixth square-grid ring 920-6 of feed elements disposed around the fifth square-grid ring 920-5, a seventh square-grid ring 920-7 of feed elements disposed around the sixth square-grid ring 920-6, and an eighth square-grid ring 920-8 of feed elements disposed around the seventh square-grid ring 920-7. In some aspects, the ring feed array 920 is centered on the focal ring such that at least one of the square-grid rings (e.g., 920-4, 920-5) of the ring feed array 920 overlaps with the focal ring and the other square-grid rings (e.g., 920-1, 920-2, 920-3, 920-6, 920-7, 920-8) of the ring feed array 920 are non-overlapping with the focal ring. In this respect, a first subset of the square-grid rings (e.g., 920-1, 920-2, 920-3) are located inside the focal ring diameter and a second subset of the square-grid rings (e.g., 920-6, 920-7, 920-8) is located outside of the focal ring diameter.

Figure 10:
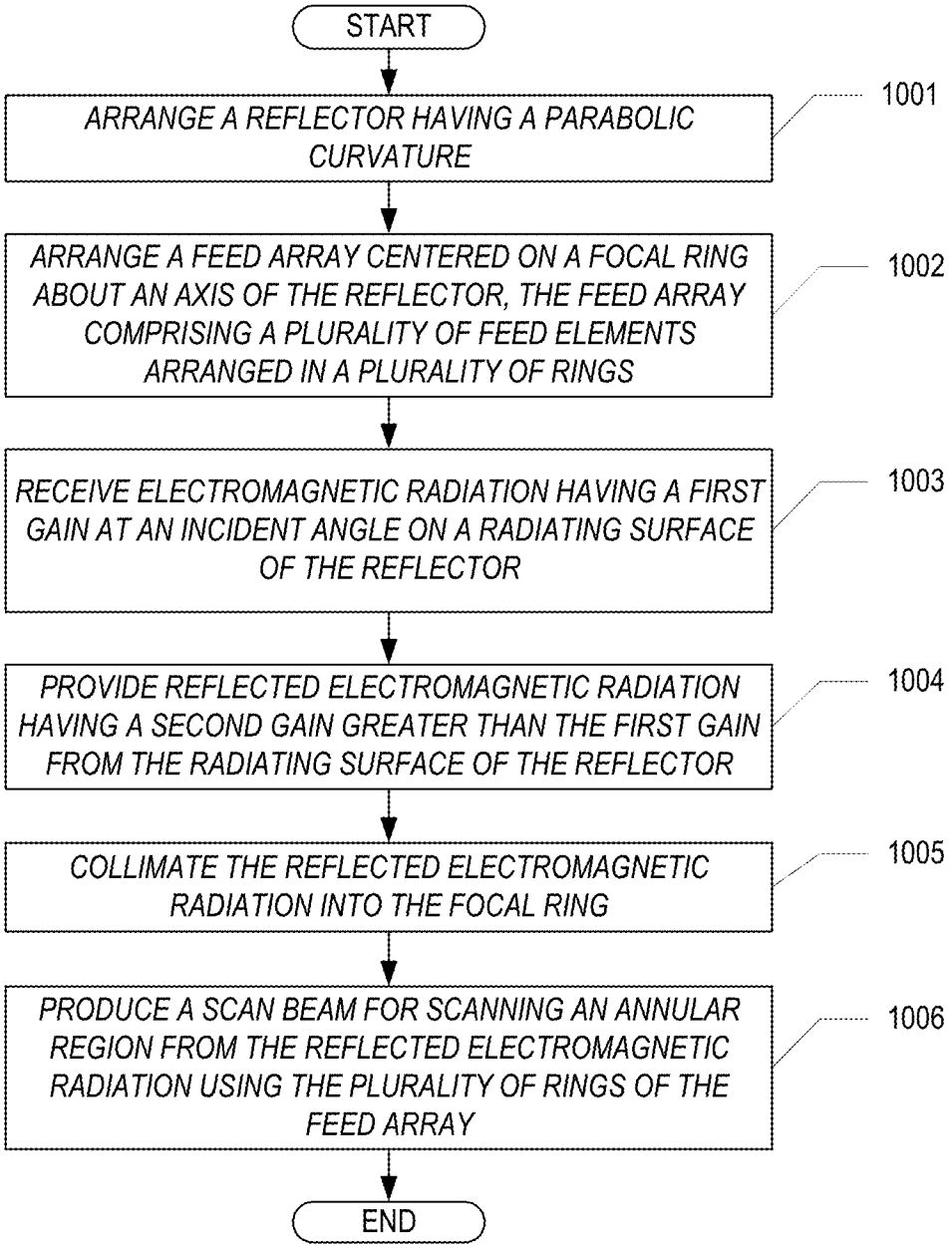
FIG. 10 illustrates a block diagram of a process for phased array fed reflectors using ring-based feed arrays according to one or more implementations of the subject technology.

FIG. 10 illustrates a block diagram of a process 1000 for phased array fed reflectors using ring-based feed arrays according to one or more implementations of the subject technology. For explanatory purposes, the process 1000 is primarily described herein with reference to the parabolic reflector 510 of the antenna system 500 of FIG. 5. However, the process 1000 is not limited to the parabolic reflector 510 of the antenna system 500 of FIG. 5, and one or more blocks (or operations) of the process 1000 may be performed by one or more other components or circuits of the antenna system 500. The data storage system 100 also is presented as an exemplary antenna and the operations described herein may be performed by any suitable antenna, such as one or more of the antenna system 600, the antenna system 700, the antenna system 800, and the antenna system 900. Further for explanatory purposes, the blocks of the process 1000 are described herein as occurring in serial, or linearly. However, multiple blocks of the process 1000 may occur in parallel. In addition, the blocks of the process 1000 need not be performed in the order shown and/or one or more blocks of the process 1000 need not be performed and/or can be replaced by other operations.

The process 1000 starts at step 1001, where a reflector having a parabolic curvature is arranged. Next, at step 1002, a feed array centered on a focal ring about an axis of the reflector is arranged. In some aspects, the feed array includes a plurality of feed elements arranged in a plurality of rings. Subsequently, at step 1003, electromagnetic radiation having a first gain is received at an incident angle on a radiating surface of the reflector. In some aspects, the gain is proportional to the radiating surface. Next, at step 1004, reflected electromagnetic radiation having a second gain greater than the first gain is provided from the radiating surface of the reflector. Subsequently, at step 1005, the reflected electromagnetic radiation is collimated into the focal ring. Next, at step 1006, a scan beam for scanning an annular region is produced from the collimated electromagnetic radiation using the plurality of rings of the feed array. In some aspects, the reflected electromagnetic radiation is collimated by at least one ring of the plurality of rings that is overlapping with the focal ring and at least one ring of the plurality of rings that is non-overlapping with the focal ring. In some implementations, the process 1000 includes a step for adjusting one or more of amplitude and phase weights on individual feed elements of the feed array for each scan angle of a plurality of scan angles, and adjusting a centroid position of the annular region based on the adjusted one or more of the amplitude and phase weights of the individual feed elements.

Figure 11:
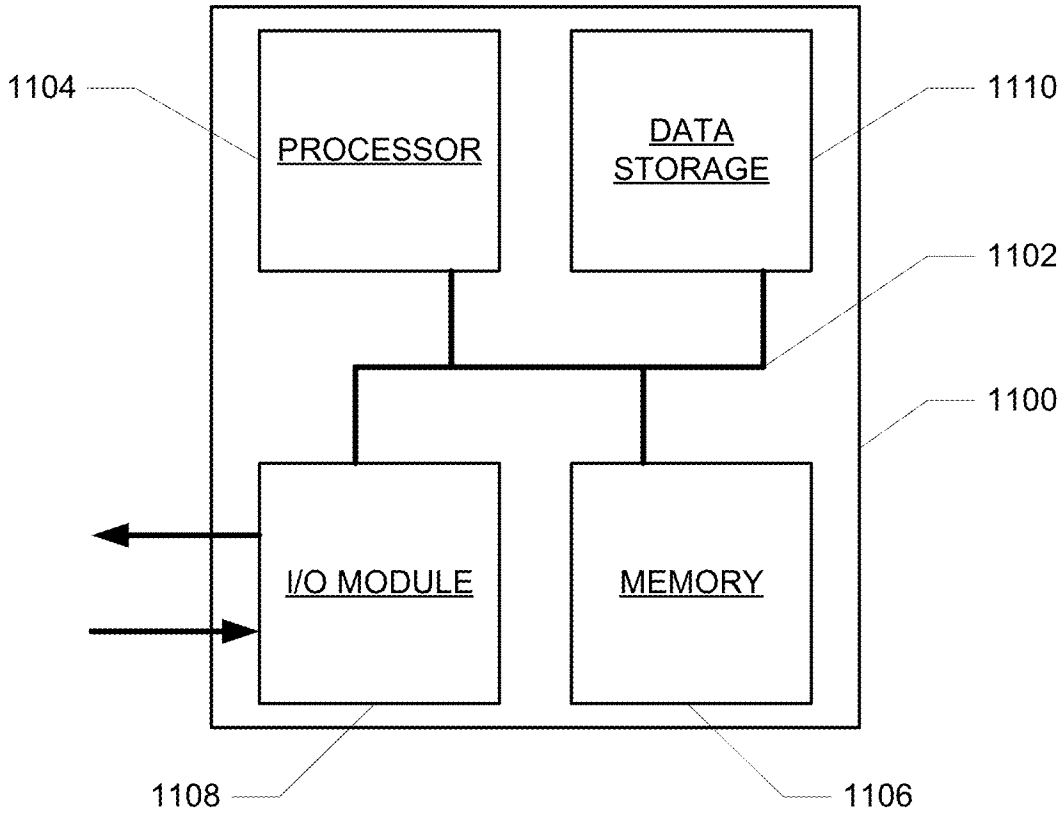
FIG. 11 is a block diagram that illustrates a computer system upon which an embodiment of the subject disclosure may be implemented.

FIG. 11 is a block diagram that illustrates a computer system 1100 upon which an embodiment of the subject disclosure may be implemented. Computer system 1100 includes a bus 1102 or other communication mechanism for communicating information, and a processor 1104 coupled with bus 1102 for processing information. Computer system 1100 also includes a memory 1106, such as a random access memory ("RAM") or other dynamic storage device, coupled to bus 1102 for storing information and instructions to be executed by processor 1104. Memory 1106 may also be used for storing temporary variables or other intermediate information during execution of instructions by processor 1104. Computer system 1100 further includes a data storage device 1110, such as a magnetic disk or optical disk, coupled to bus 1102 for storing information and instructions.

Computer system 1100 may be coupled via I/O module 1108 to a display device (not illustrated), such as a liquid crystal display ("LCD"), a light-emitting diode ("LED") display, or a combination thereof, for displaying information to a computer user. An input device, such as, for example, a keyboard or a mouse may also be coupled to computer system 1100 via I/O module 1108 for communicating information and command selections to processor 1104.

According to one embodiment of the subject disclosure, generating and configuring a plurality of beams with an antenna system may be performed by a computer system 1100 in response to processor 1104 executing one or more sequences of one or more instructions contained in memory 1106. Such instructions may be read into memory 1106 from another machine-readable medium, such as data storage device 1110. Execution of the sequences of instructions contained in main memory 1106 causes processor 1104 to perform the process steps described herein. One or more processors in a multi-processing arrangement may also be employed to execute the sequences of instructions contained in memory 1106. In alternative embodiments, hard-wired circuitry may be used in place of or in combination with software instructions to implement various embodiments of the subject disclosure. Thus, embodiments of the subject disclosure are not limited to any specific combination of hardware circuitry and software.

The term "machine-readable medium" as used herein refers to any medium that participates in providing instructions to processor 1104 for execution. Such a medium may take many forms, including, but not limited to, non-volatile media, volatile media, and transmission media. Non-volatile media include, for example, optical or magnetic disks, such as data storage device 1110. Volatile media include dynamic memory, such as memory 1106. Transmission media include coaxial cables, copper wire, and fiber optics, including the wires that comprise bus 1102. Transmission media can also take the form of acoustic or light waves, such as those generated during radio frequency and infrared data communications. Common forms of machine-readable media include, for example, floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH EPROM, any other memory chip or cartridge, a carrier wave, or any other medium from which a computer can read.

The description of the subject technology is provided to enable any person skilled in the art to practice the various embodiments described herein. While the subject technology has been particularly described with reference to the various figures and embodiments, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these embodiments may be readily apparent to those skilled in the art, and generic principles defined herein may be applied to other embodiments. Thus, many changes and modifications may be made to the subject technology, by one having ordinary skill in the art, without departing from the scope of the subject technology.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various embodiments described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A receiver system, comprising:

a reflector having a focal plane and a parabolic curvature configured to receive electromagnetic radiation with a first gain and provide reflected electromagnetic radiation with a second gain greater than the first gain;

a feed array comprising a plurality of rings, each of the plurality of rings comprising a plurality of feed elements configured to receive the reflected electromagnetic radiation from the reflector and produce a beam;

a radio-frequency (RF) path configured to receive RF signals from the feed array and generate electrical signals; and a beamformer configured to receive the electrical signals from the RF path and to create one or more composite beams, wherein the feed array is centered on a focal ring such that at least one of the plurality of rings overlaps with the focal ring and remaining rings of the plurality of rings are non-overlapping with the focal ring, and wherein each of the plurality of feed elements is arranged on an inclined angle relative to the focal plane.

2. The receiver system of claim 1, wherein the beam is a pencil beam.

3. The receiver system of claim 1, wherein the beam is an annular beam.

4. The receiver system of claim 1, wherein each of the plurality of feed elements is disposed in the focal plane of the reflector.

5. The receiver system of claim 1, wherein the plurality of rings comprise square-grid rings, wherein a size of each of the plurality of feed elements of the square-grid rings is $1\lambda \times 1\lambda$, and wherein $\lambda$ denote a wavelength of the electromagnetic radiation.

6. The receiver system of claim 1, wherein the feed array has a focal length-to-diameter ratio value in a range of 0.5 to 1.0, where a focal length corresponds to a distance between the feed array and the reflector, and a diameter corresponds to a diameter of the reflector.

7. The receiver system of claim 1, wherein a first ring of the plurality of rings that forms a first diameter of the feed array has a first focal length to the reflector and a second ring of the plurality of rings that forms a second diameter of the feed array has a second focal length to the reflector, wherein the second diameter is greater than the first diameter, and wherein the second focal length is greater than the first focal length.

8. The receiver system of claim 1, wherein each of the plurality of feed elements is arranged parallel to the focal plane.

9. The receiver system of claim 1, wherein the plurality of feed elements of the plurality of rings are arranged about the focal ring at different radii.

10. The receiver system of claim 1, wherein the feed array has one of a radial grid arrangement, a square grid arrangement, a rectangular grid arrangement, or a sparse grid arrangement.

11. The receiver system of claim 1, wherein the reflector is not tilted relative to the focal plane for beam coverage within a conical scan volume about boresight.

12. The receiver system of claim 1, wherein the reflector comprises an offset paraboloid of revolution.

13. The receiver system of claim 1, further comprising a sub-reflector that comprises a tilted ellipse of revolution, wherein the sub-reflector has a pointed vertex that directs electromagnetic radiation along an axis of the reflector towards the reflector.

14. The receiver system of claim 13, wherein the feed array is interposed between the reflector and the sub-reflector.

15. A method, comprising:

receiving electromagnetic radiation with a first gain at an incident angle on a radiating surface of a reflector having a parabolic curvature;

providing reflected electromagnetic radiation with a second gain greater than the first gain from the radiating surface of the reflector;

collecting the reflected electromagnetic radiation by a feed array including a plurality of rings and centered at a focal ring about an axis of the reflector, at least one ring of the plurality of rings overlapping with the focal ring and at least one ring of the plurality of rings being non-overlapping with the focal ring;

receiving, by a radio-frequency (RF) path, RF signals from the feed array and converting the RF signals to electrical signals; and receiving, by a beamformer, the electrical signals from the RF path and creating one or more composite beams, wherein the reflector has a focal plane, the plurality of rings comprises a plurality of feed elements, and the plurality of feed elements is arranged on an inclined angle relative to the focal plane.

16. The method of claim 15, further comprising:

adjusting one or more of amplitude and phase weights on individual feed elements of the feed array for each scan angle of a plurality of scan angles; and adjusting a centroid position of an annular region based on the adjusted one or more of the amplitude and phase weights of the individual feed elements.

17. The method of claim 15, wherein the plurality of feed elements of the plurality of rings are arranged about the focal ring at different radii.

18. An antenna system, comprising:

a main reflector having a parabolic curvature configured to receive electromagnetic radiation with a first gain and provide first reflected electromagnetic radiation with a second gain greater than the first gain;

a sub-reflector that is a tilted conic of revolution and configured to receive the first reflected electromagnetic radiation and produce a second reflected electromagnetic radiation; and a plurality of feed antennas arranged in a ring, each of the plurality of feed antennas being disposed in a focal plane of the main reflector, and each of the plurality of feed antennas configured to interact with the second reflected electromagnetic radiation from the sub-reflector and provide a radio-frequency (RF) signal, wherein a first axis of the first reflected electromagnetic radiation is at an angle with a second axis of the second reflected electromagnetic radiation, and wherein each of the plurality of feed antennas is arranged on an inclined angle relative to the focal plane.

19. The antenna system of claim 18, wherein the sub-reflector has a pointed vertex that directs electromagnetic radiation along an axis of the main reflector towards the plurality of feed antennas, and wherein the plurality of feed antennas is interposed between the main reflector and the sub-reflector.

20. The antenna system of claim 18, wherein the plurality of feed antennas is arranged about a focal ring at different radii.

* * * * *